US011654587B2

(12) United States Patent
Kopelas et al.

(10) Patent No.: US 11,654,587 B2
(45) Date of Patent: May 23, 2023

(54) COUPLING MECHANISM

(71) Applicant: BIC VIOLEX S.A., Anoixi (GR)

(72) Inventors: Panagiotis Kopelas, Anoixi (GR); Sam Pearce, Nottinghamshire (GB)

(73) Assignee: BIC Violex Single Member S.A., Anoixi (GR)

( * ) Notice: Subject to any disclaimer, the term of this patent is extended or adjusted under 35 U.S.C. 154(b) by 9 days.

(21) Appl. No.: 17/242,407

(22) Filed: Apr. 28, 2021

(65) Prior Publication Data

US 2021/0354321 A1 Nov. 18, 2021

(30) Foreign Application Priority Data

May 13, 2020 (EP) ..... 20174349

(51) Int. Cl.
*B26B 21/52* (2006.01)

(52) U.S. Cl.
CPC ..... *B26B 21/521* (2013.01)

(58) Field of Classification Search
None
See application file for complete search history.

(56) References Cited

U.S. PATENT DOCUMENTS 4,756,082 A * 7/1988 Apprille, Jr. ..... B26B 21/225 30/57
5,956,851 A * 9/1999 Apprille, Jr. ..... B26B 21/521 30/526
10,350,774 B2 7/2019 Wilson et al.
2009/0235539 A1* 9/2009 Wonderley ..... B26B 21/521 30/527
2009/0255136 A1 10/2009 Blackburn
2010/0132204 A1* 6/2010 Brown ..... B26B 21/225 30/527

(Continued)

FOREIGN PATENT DOCUMENTS

EP 1488894 A1 12/2004
EP 2227360 B1 2/2012

(Continued)

OTHER PUBLICATIONS

English translation (machine-generated) of KR 2017-0029310A, Mar. 2017.*

(Continued)

*Primary Examiner* — Hwei-Siu C Payer
(74) *Attorney, Agent, or Firm* — Bookoff McAndrews, PLLC

(57) ABSTRACT

A coupling mechanism for a shaving device comprising a first connector a second connector defining a cavity being configured to receive the first connector, a first coupling element included on the second connector, the first coupling element configured to move between a first coupling element first position and a first coupling element second position, a second coupling element positioned within the cavity, the second coupling element configured to move between a second coupling element first position and a second coupling element second position, and wherein movement of the second coupling element to the second coupling element second position causes the first coupling element to be maintained in the first coupling element second position to secure engagement of the first connector and the second connector.

20 Claims, 5 Drawing Sheets

(56) References Cited

U.S. PATENT DOCUMENTS

| | | | | |
|---|---|---|---|---|
| 2011/0088269 | A1 | 4/2011 | Walker, Jr. et al. | |
| 2015/0174776 | A1* | 6/2015 | Hawes | B26B 21/14 30/526 |
| 2019/0176355 | A1* | 6/2019 | Mazarakis | B26B 21/225 |
| 2020/0023531 | A1* | 1/2020 | Hitchcock | B26B 21/225 |
| 2020/0070376 | A1* | 3/2020 | Petratou | B26B 21/521 |
| 2021/0129365 | A1* | 5/2021 | Kopelas | B26B 21/4062 |
| 2021/0187769 | A1* | 6/2021 | Kopelas | B26B 21/225 |
| 2021/0339416 | A1* | 11/2021 | Kopelas | B26B 21/222 |
| 2021/0354321 | A1* | 11/2021 | Kopelas | B26B 21/225 |
| 2021/0379777 | A1* | 12/2021 | Kopelas | B26B 21/521 |

FOREIGN PATENT DOCUMENTS

| | | | | |
|---|---|---|---|---|
| EP | 3398737 | A1 | | 11/2018 |
| KR | 10-2017-0029310 | | * | 3/2017 |
| KR | 10-2017-0029314 | | * | 3/2017 |
| WO | 9836880 | A1 | | 8/1998 |
| WO | 2019067574 | A1 | | 4/2019 |

OTHER PUBLICATIONS

English translation (machine-generated) of KR 2017-0029314A, Mar. 2017.*

Extended European search report issued in European Patent Application No. 20174349.9, dated Oct. 13, 2020.

* cited by examiner

COUPLING MECHANISM

CROSS-REFERENCE TO RELATED APPLICATION(S)

This application claims benefit from European patent application EP 20174349.9, filed on May 13$^{th}$ 2020, its content being incorporated herein by reference.

FIELD

The present disclosure relates generally to the field of skincare, and in particular to shaving. More specifically, the present disclosure relates to a coupling mechanism for connecting a replaceable shaving cartridge of a shaving device to a handle of a shaving device.

BACKGROUND ART

A typical handheld shaving device includes a handle and replaceable shaving cartridges or heads which are configured to connect to the handle via a coupling mechanism. The coupling mechanism should provide for a safe and secure coupling and decoupling of the replaceable shaving cartridge to and from the handle, while also ensuring that the coupling and decoupling of the replaceable shaving cartridge to and from the handle is a smooth and seamless experience for a user.

Currently available coupling mechanisms may use magnetic components and/or metallic components to secure the shaving cartridge to the handle by magnetic attraction. These currently available coupling mechanisms require magnetic components and/or metallic components on the shaving cartridge and/or the handle. However, incorporating a magnetic component and/or a metallic component into the shaving cartridge increases production cost (cost of magnets/metallic parts and cost of assembly on the cartridge) on a part—the shaving cartridge—of the shaving device which is disposed after use. Additionally, usage of magnetic components and/or metallic components on a disposable part of the shaving device, such as the shaving cartridge, negatively impacts sustainability and the environment, as the magnetic and metallic components have a longer lifespan than the shaving cartridge but are disposed of nonetheless.

It is desirable to provide an improved coupling mechanism for attaching a replaceable shaving cartridge of a shaving device to a handle of a shaving device which limits use of magnetic and metallic components to the handle of the shaving device, such that the replaceable shaving cartridge is free from magnetic and metallic components, in order to fulfill one or more of the needs described above.

SUMMARY

According to aspects of the disclosure, a coupling mechanism for a shaving device comprises a first connector, a second connector defining a cavity being configured to receive the first connector, a first coupling element included on the second connector, the first coupling element configured to move between a first coupling element first position and a first coupling element second position, a second coupling element also included on the second connector and positioned within the cavity, the second coupling element configured to move between a second coupling element first position and a second coupling element second position, and wherein movement of the second coupling element to the second coupling element second position causes the first coupling element to be maintained in the first coupling element second position to secure engagement of the first connector and the second connector.

According to aspects of the disclosure, a third coupling element may be included within the second connector, and the third coupling element may be configured to repel the first coupling element when the second coupling element is in the second coupling element first position.

According to aspects of the disclosure, the third coupling element may be configured to be attracted to the second coupling element.

According to aspects of the disclosure, the first coupling element may be configured to be attracted to the second coupling element.

According to aspects of the disclosure, two of the first coupling element, second coupling element, and the third coupling element may include a magnet, and one of the first coupling element, the second coupling element, and the third coupling element may include a ferromagnetic material.

According to aspects of the disclosure, the first coupling element may be aligned with the second coupling element when the first coupling element is in the first coupling element second position and the second coupling element is in the second coupling element second position.

According to aspects of the disclosure, the first coupling element may be configured to pivot between the first coupling element first position and the first coupling element second position.

According to aspects of the disclosure, the first connector may define a slot and the second connector may define an opening, and the slot may be configured to align with the opening.

According to aspects of the disclosure, the first coupling element may be configured to extend through the opening and the slot when the first coupling element is in the first coupling element second position.

According to aspects of the disclosure, the first connector may include an engagement surface configured to engage the second coupling element, and engagement of the second coupling element by the engagement surface moves the second coupling element toward the second coupling element second position when the first connector is inserted into the cavity.

According to aspects of the disclosure, the second coupling element may include a bias member and the first connector may compress the bias member to move the second coupling element toward the second coupling element second position.

According to aspects of the disclosure, the engagement surface of the first connector may engage the bias member.

According to aspects of the disclosure, the bias member may be compressed against an inner wall of the second connector.

According to aspects of the disclosure, a button may be connected to the second coupling element, and the button may be configured to move the second coupling element to the second coupling element first position.

According to aspects of the disclosure, a shaving device may comprise a handle, a shaving cartridge, and the coupling mechanism according to any aspect described herein, and the shaving cartridge may be coupled to the handle when the first connector and the second connector are securely engaged.

According to aspects of the disclosure, a method of coupling a shaving cartridge to a handle of a shaving device may comprise the coupling mechanism according to any aspect described herein.

In the manner described and according to aspects illustrated herein, the coupling mechanism may be configured for attaching a replaceable shaving cartridge of a shaving device to a handle of a shaving device while limiting use of magnetic and metallic coupling elements to the handle of the shaving device, such that the replaceable shaving cartridge is substantially free from magnetic and metallic coupling elements.

BRIEF DESCRIPTION OF THE DRAWINGS

Aspects of an embodiment will be described in reference to the drawings, where like numerals reflect like elements.

DETAILED DESCRIPTION

Figure 1:
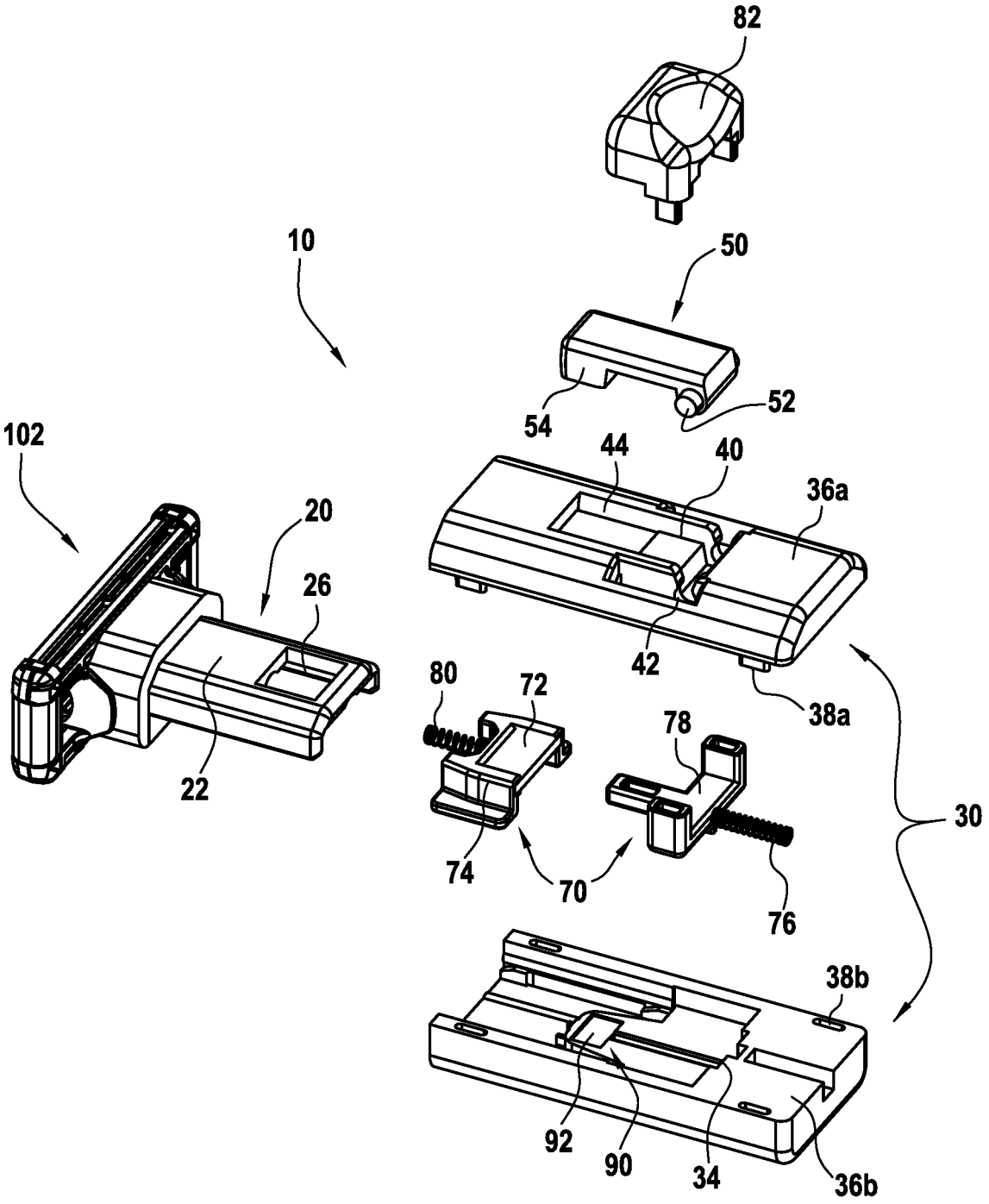
FIG. 1 is a side perspective exploded view of a coupling mechanism for a shaving device according to aspects of the disclosure.
Figure 2:
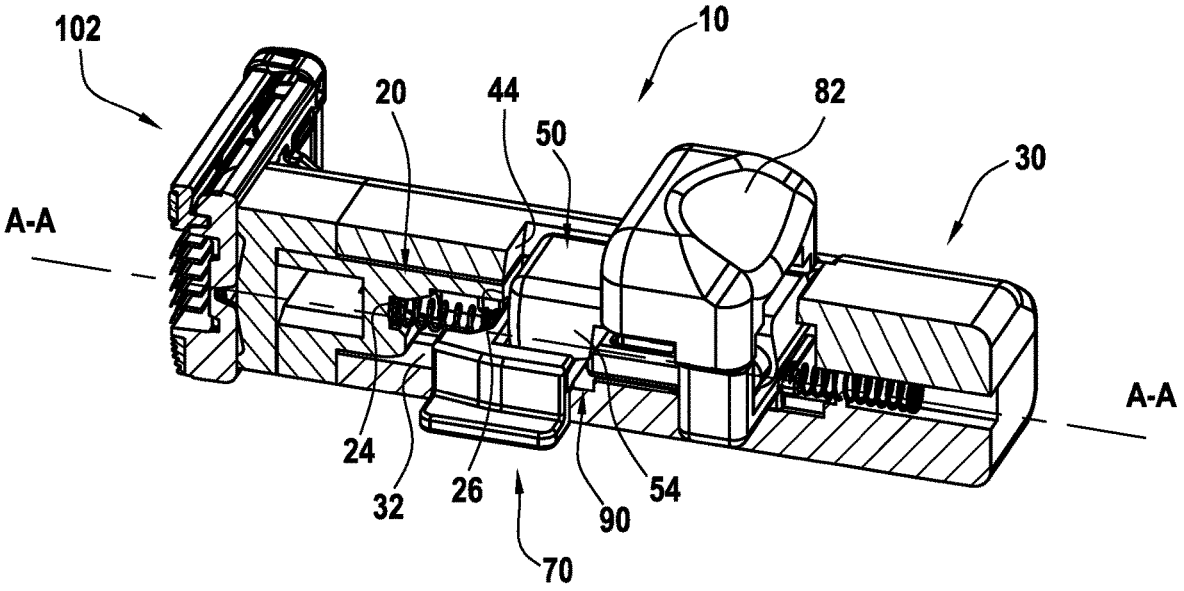
FIG. 2 is a side perspective view of the coupling mechanism of FIG. 1, showing a first connector and a second connector of the coupling mechanism in cross-section.

An embodiment of the coupling mechanism according to aspects of the disclosure will now be described with reference to FIGS. 1-9. Like numerals represent like parts, and will generally be referred to by the reference numeral 10. Although the coupling mechanism 10 is described with reference to specific examples, it should be understood that modifications and changes may be made to these examples without going beyond the general scope as defined by the claims. In particular, individual characteristics of the various embodiments shown and/or mentioned herein may be combined in additional embodiments. Consequently, the description and the drawings should be considered in a sense that is illustrative rather than restrictive. The Figures, which are not necessarily to scale, depict illustrative aspects and are not intended to limit the scope of the disclosure. The illustrative aspects depicted are intended only as exemplary.

The term "exemplary" is used in the sense of "example," rather than "ideal." While aspects of the disclosure are amenable to various modifications and alternative forms, specifics thereof have been shown by way of example in the drawings and will be described in detail. It should be understood, however, that the intention is not to limit aspects of the disclosure to the particular embodiment(s) described. On the contrary, the intention of this disclosure is to cover all modifications, equivalents, and alternatives falling within the scope of the disclosure.

Various materials, methods of construction and methods of fastening will be discussed in the context of the disclosed embodiment(s). Those skilled in the art will recognize known substitutes for the materials, construction methods, and fastening methods, all of which are contemplated as compatible with the disclosed embodiment(s) and are intended to be encompassed by the appended claims.

As used in this disclosure and the appended claims, the singular forms "a," "an," and "the" include plural referents unless the content clearly dictates otherwise. As used in this disclosure and the appended claims, the term "or" is generally employed in its sense including "and/or" unless the content clearly dictates otherwise.

Throughout the description, including the claims, the terms "comprising a," "including a," and "having a" should be understood as being synonymous with "comprising one or more," "including one or more," and "having one or more" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially," "approximately," and "generally" should be understood to mean falling within such accepted tolerances.

When an element or feature is referred to herein as being "on," "engaged to," "connected to," or "coupled to" another element or feature, it may be directly on, engaged, connected, or coupled to the other element or feature, or intervening elements or features may be present. In contrast, when an element or feature is referred to as being "directly on," "directly engaged to," "directly connected to," or "directly coupled to" another element or feature, there may be no intervening elements or features present. Other words used to describe the relationship between elements or features should be interpreted in a like fashion (e.g., "between" versus "directly between," "adjacent" versus "directly adjacent," etc.).

Spatially relative terms, such as "top," "bottom," "middle," "inner," "outer," "beneath," "below," "lower," "above," "upper," and the like, may be used herein for ease of description to describe one element or feature's relationship to another element(s) or feature(s) as illustrated in the drawings. Spatially relative terms may be intended to encompass different orientations of a device in use or operation in addition to the orientation depicted in the drawings. For example, if the device in the drawings is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although the terms "first," "second," etc. may be used herein to describe various elements, components, regions, layers, sections, and/or parameters, these elements, components, regions, layers, sections, and/or parameters should not be limited by these terms. These terms are only used to distinguish one element, component, region, layer, or section from another region, layer, or section. Thus, a first element, component, region, layer, or section discussed herein could be termed a second element, component, region, layer, or section without departing from the teachings of the present disclosure.

The coupling mechanism 10 may be configured to couple parts of a product, such as a handheld shaving device having a head/replaceable shaving cartridge (first part) 102 and a handle (second part) (not shown). As shown in FIG. 1, the coupling mechanism 10 may include a first connector 20, a second connector 30, a first coupling element 50, second coupling element 70, and a third coupling element 90. The first coupling element 50, second coupling element 70, and third coupling element 90 may include a magnetic component and/or a metallic component for causing the first connector 20 and the second connector 30 to be coupled or decoupled. In the disclosed embodiment, the first connector 20 may be attached to the shaving cartridge 102 of the product and the second connector 30 may be attached to the handle of the product. The first connector 20 and the second connector 30 may be integrally formed with the shaving cartridge 102 and the handle, respectively. However, it is contemplated that the first connector 20 and the second connector 30 may be separate from the shaving cartridge 102 and the handle, respectively, and may attach to the shaving cartridge 102 and the handle via an attachment connection such as an interference-fit connection.

As illustrated by FIGS. 3-9, the first connector 20 and the second connector 30 may be configured to transition between a coupled state and an uncoupled state. The first connector 20 and the second connector 30 may transition between the coupled state and the uncoupled state along an axis A-A. In the disclosed embodiment, the first connector 20 is received by the second connector 30 along the axis A-A. In the coupled state, the first connector 20 may be securely coupled to the second connector 30 in a locked relationship (see FIG. 7). In the uncoupled state, the first connector 20 may be decoupled from the second connector 30 (see FIG. 3). The first connector 20 may be ejected or released from the locked relationship with the second connector 30.

Figure 3:
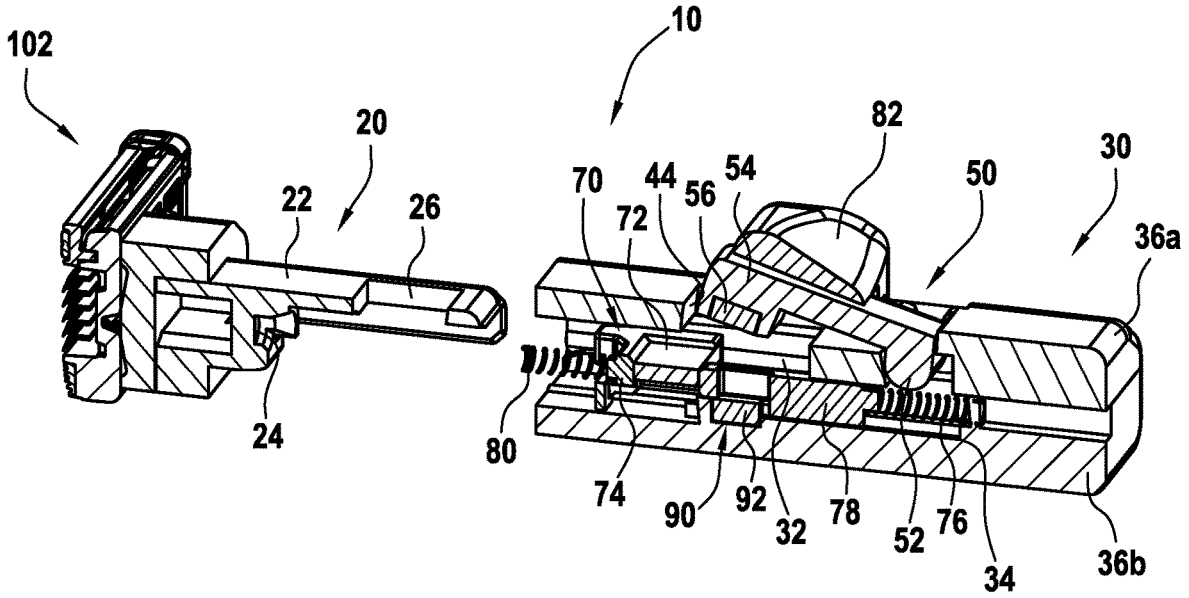
FIG. 3 is a side cross-sectional perspective view of the coupling mechanism of FIG. 1.

As shown in FIGS. 1 and 3, the first connector 20 may include an extension 22 configured to extend along the axis A-A. The extension 22 may be configured to project away from the shaving cartridge 102. The first connector 20 may include an engagement surface 24 configured to engage the second coupling element 70 as the first connector 20 and the second connector 30 transition from the uncoupled state to the coupled state. The extension 22, and thus the first connector 20, may define a slot 26 configured to receive and/or engage the first coupling element 50. Receipt and/or engagement of the first coupling element 50 within the slot 26 of the first connector 20 may secure the locked relationship between the first connector 20 and the second connector 30.

As shown in FIGS. 1 and 3, the second connector 30 may define a cavity 32 configured to extend along the axis A-A. The cavity 32 may extend to an inner wall 34 of the second connector 30. The cavity 32, and thus the second connector 30, may be configured to receive the first connector 20. In the disclosed embodiment, the second connector 30 may include a first housing part **36*a* and an opposing second housing part 36*b*. The first housing part 36*a* and the second housing part 36*b* may engage each other to define the cavity 32. The first housing part 36*a* may include retention tabs 38a which are received in complementary retention openings 38b defined by the second housing part 36*b*. It is also contemplated that the first housing part 36*a* and the second housing part 36*b*** may be constructed as one integral structure.

The first coupling member 50, the second coupling member 70, and the third coupling member 90 may be present on and/or included within the second connector 30 so that all magnetic components and metallic components may be present on and/or included within the handle, and not the shaving cartridge 102. As such, the coupling mechanism 10 is configured to utilize magnetic components and metallic components for coupling and decoupling the shaving cartridge 102 to and from the handle, while ensuring that the shaving cartridge 102 is free from utilizing the magnetic and metallic components.

The first coupling member 50 may be configured to pivot about the second connector 30. As such, the first housing part **36*a* of the second connector 30 may include a recess 40 for receiving the first coupling element 50. The recess 40 may include a pivot groove 42 for receiving a pivot bar 52 included by the first coupling element 50. The pivot bar 52 may be configured to pivot within the pivot groove 42 to allow the first coupling element 50 to pivot about the second connector 30. The second connector 30 may define an opening 44 configured to receive a locking member 54 of the first coupling element 50 due to pivoting of the first coupling element 50. The opening 44 may receive the locking member 54 of the first coupling element 50 so that the first coupling element 50 may engage the slot 26 of the first connector 20. As such, the opening 44 is configured to align with the slot 26**.

The cavity 32 may be configured to receive the second coupling element 70. As such, the second coupling element 70 may be positioned within the cavity 32. The second coupling element 70 may extend throughout the cavity 32 to the inner wall 34 of the second connector 30. The third coupling element 90 may also be positioned within the cavity 32 of the second connector 30. The third coupling element 90 may be configured to be attracted to the second coupling element 70. Additionally or alternatively, the third coupling element 90 may be configured to repel the first coupling element 50. The third coupling element 90 may be a magnetic component or a metallic component secured to the second connector 30. In the disclosed embodiment, the third coupling element 90 is a magnet 92. The magnet 92 may be secured to the second housing part **36*b***.

As illustrated by FIGS. 3-9, the first coupling element 50 may be configured to move between a first coupling element first position and a first coupling element second position. In the disclosed embodiment, the first coupling element 50 may pivot between the first coupling element first position and the first coupling element second position. In the first coupling element first position, the locking member 54 of the first coupling element 50 may not extend through the opening 44 defined by the second connector 30 to engage the slot 26 defined by the first connector 20. In the first coupling element second position, the locking member 54 of the first coupling element 50 may extend through the opening 44 defined by the second connector 30 to engage the slot 26 defined by the first connector 20. The locking member 54 may extend through the slot 26 when the locking member 54 engages the slot 26. Extension of the locking member 54 through the slot 26 may restrict the first connector 20 from moving axially away from the second connector 30, in order to restrict decoupling of the first connector 20 and the second connector 30.

The first coupling element 50 may be configured to be attracted to the second coupling element 70. Additionally or alternatively, the first coupling element 50 may be configured to repel the third coupling element 90. Attraction and repulsion of the first coupling element 50 may be configured to cause the first coupling element 50 to move between the first coupling element first position and the first coupling element second position and to secure the first coupling element 50 in the first coupling element second position. As such, the first coupling element 50 may include a magnetic component or a metallic component. In the disclosed embodiment, the first coupling element 50 may include a magnet 56 secured to the locking member 54. In the disclosed embodiment, like poles of the magnet 56 of the first coupling element 50 and the magnet 92 of the third coupling element 90 may face each other, causing repulsion between the first coupling element 50 and the third coupling element 90.

As illustrated by FIGS. 3-9, the second coupling element 70 may be configured to be attracted to the first coupling element 50. Additionally, the second coupling element 70 may be configured to be attracted to the third coupling element 90. As such, the second coupling element 70 may include a magnetic component or a metallic component. In examples, the second coupling element 70 may include a ferromagnetic material. In the disclosed embodiment, the second coupling element 70 may include a metal plate 72 secured to a base 74. The second coupling element 70 may be configured to move between a second coupling element first position and a second coupling element second position. In the second coupling element first position, the metal plate 72 of the second coupling element 70 may not be aligned with the slot 26 of the first connector 20, the opening of the second connector 30, and/or the magnet 92 of the third coupling element 90. In the second coupling element second position, the metal plate 72 of the second coupling element 70 may align with the slot 26 of the first connector 20, the opening of the second connector 30, and/or the magnet 92 of the third coupling element 90. Movement of the second coupling element 70 from the second coupling element first position to the second coupling element second position may cause the first coupling element 50 to move from the first coupling element first position to the first coupling element second position. Movement of the second coupling element 70 from the second coupling element second position toward the second coupling element first position may cause the first coupling element 50 to move from the first coupling element second position to the first coupling element first position.

The second coupling element 70 may include a first bias member 76. Additionally or alternatively, the second coupling element 70 may include a pusher 78, separate from the base 74, which includes the first bias member 76; however, it is contemplated that the base 74 and the pusher 78 may be constructed as one integral structure. The first bias member 76 may bias the second coupling element 70 toward the second coupling element first position. The first bias member 76 may be configured to be compressed against the inner wall 34 of the second connector 30. The first bias member 76 may also be secured to the inner wall 34 of the second connector 30. In the disclosed embodiment, the first bias member 76 is a coil spring; however, a person having ordinary skill in the art would appreciate that other bias members may be compatible with the coupling mechanism 10. The second coupling element 70 may include a second bias member 80. The second bias member 80 may have a greater stiffness than the first bias member 76. The second bias member 80 may be included on the base 74. The second bias member 80 may be configured to be compressed against the engagement surface 24 of the first connector 20. The first connector 20 may be configured to move the second coupling element 70 from the second coupling element first position to the second coupling element second position. In the disclosed embodiment, the second bias member 80 is a coil spring; however, a person having ordinary skill in the art would appreciate that other bias members may be compatible with the coupling mechanism 10. The second coupling element 70 may include a button 82 configured to be manipulated by a user. Manipulation of the button 82 by the user may cause the second coupling element 70 to move from the second coupling element second position to the second coupling element first position to decouple the first connector 20 from the second connector 30.

Figure 4:
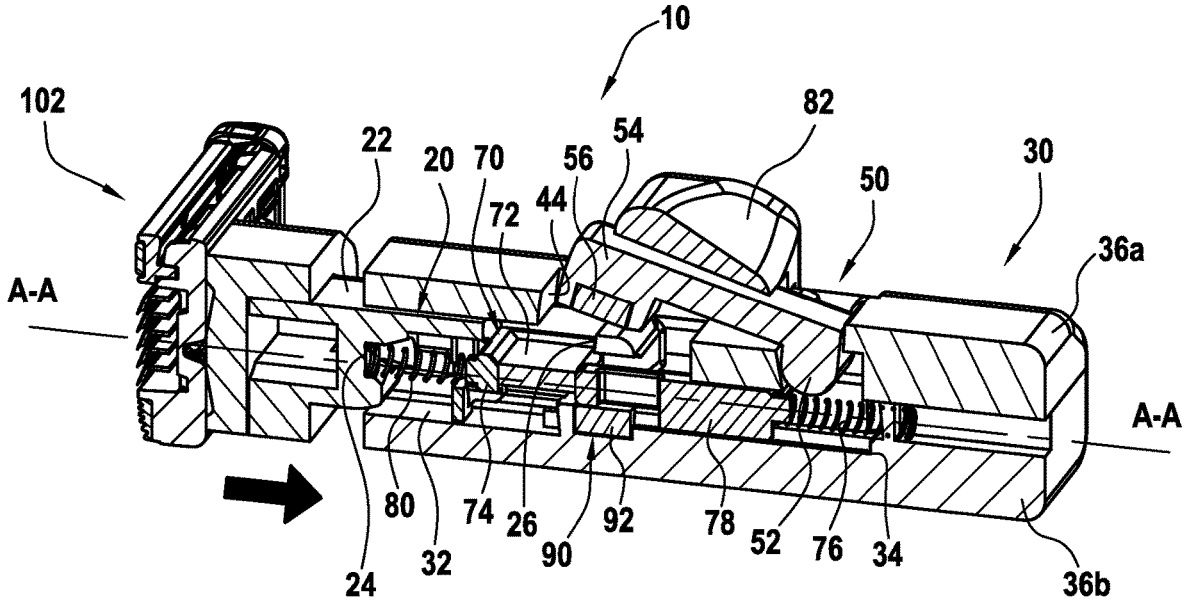
FIG. 4 is a side cross-sectional perspective view of the coupling mechanism of FIG. 1.
Figure 5:
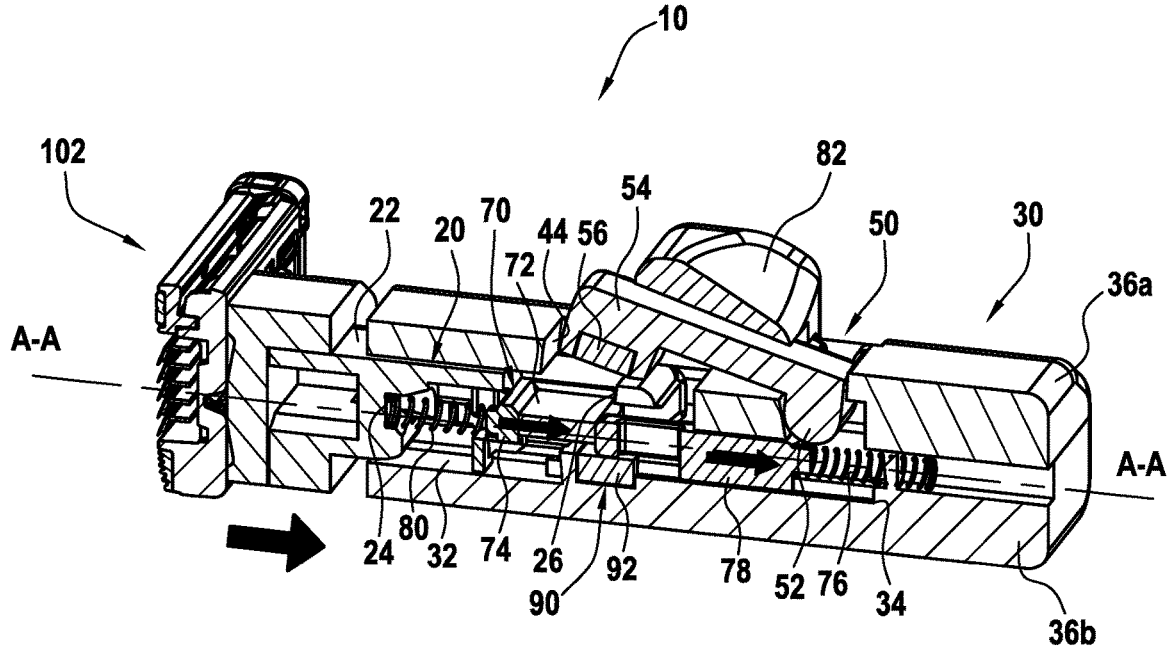
FIG. 5 is a side cross-sectional perspective view of the coupling mechanism of FIG. 1.
Figure 6:
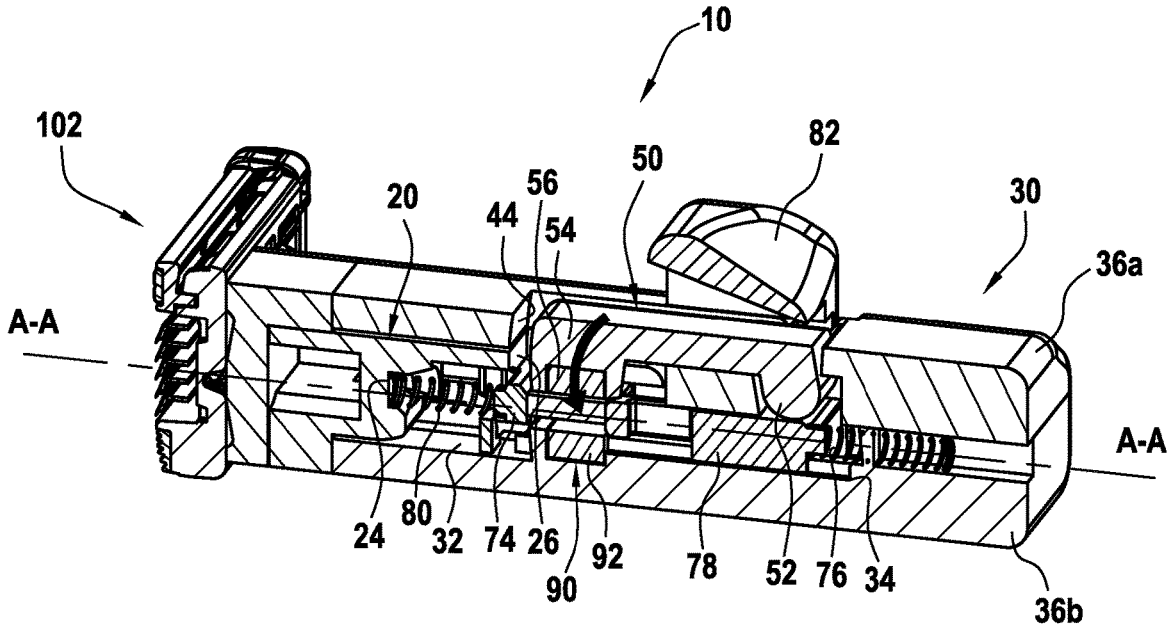
FIG. 6 is a side cross-sectional perspective view of the coupling mechanism of FIG. 1.

As illustrated by FIGS. 4-6, insertion of the first connector 20 into the cavity 32 of the second connector 30 may transition the first connector 20 and the second connector 30 from the decoupled state to the coupled state. In operation, insertion of the first connector 20 into the cavity 32 of the second connector 30 may cause the engagement surface 24 of the first connector 20 to engage the second bias member 80. As the first connector 20 is inserted further into the second connector 30, the first bias member 76 may compress such that the second coupling element 70 may move towards the second coupling element second position. Moving the second coupling element 70 toward the second coupling element second position may allow the slot 26 of the first connector 20 to align with the opening 44 of the second connector 30. Additionally, movement of the second coupling element 70 toward the second coupling element second position may move the metal plate 72 of the second coupling element 70 into alignment with the slot 26 of the first connector 20, the opening 44 of the second connector 30, and the magnet 92 of the third coupling element 90. Once the first bias member 76 reaches maximum compression, movement of the first connector 20 into the second connector 30 causes the second bias member 80 to compress so that the second coupling element 70 may align with the third coupling element 90. Once the second coupling element 70 is aligned with the third coupling element 90, the metal plate 72 of the second coupling element 70 may be aligned with the slot 26 of the first connector 20, the opening 44 of the second connector 30, and the magnet 92 of the third coupling element 90. The magnet 92 of the third coupling element 90 may attract the metal plate 72 of the second coupling element 70. Additionally, the metal plate 72 of the second coupling element 70 may be positioned between the magnet 92 of the third coupling element 90 and the magnet 56 of the first coupling element 50. Positioning of the metal plate 72 of the second coupling element 70 between the magnet 92 of the third coupling element 90 and the magnet 56 of the first coupling element 50 may block the repulsion between the magnet 92 of the third coupling element 90 and the magnet 56 of the first coupling element 50. Additionally, the metal plate 72 of the second coupling element 70 may attract the magnet 56 of the first coupling element 50. Attraction of the magnet 56 of the first coupling element 50 may cause the first coupling element 50 to pivot towards the opening 44 of the second connector 30 and the slot 26 of the first connector 20. The locking member 54 may pivot into the opening 44 of the second connector 30 and the slot 26 of the first connector 20 so that the locking member 54 engages the slot 26 of the first connector 20. Engagement of the slot 26 of the first connector 20 by the locking member 54 of the first coupling element 50, with a magnetic attraction between the magnet 56 of the first coupling element 50 and the metal plate 72 of the second coupling element 70 and the magnet 92 of the third coupling element 90 and the metal plate 72 of the second coupling element 70, may hold the first connector 20 and the second connector 30 in a secure, locked relationship.

Figure 7:
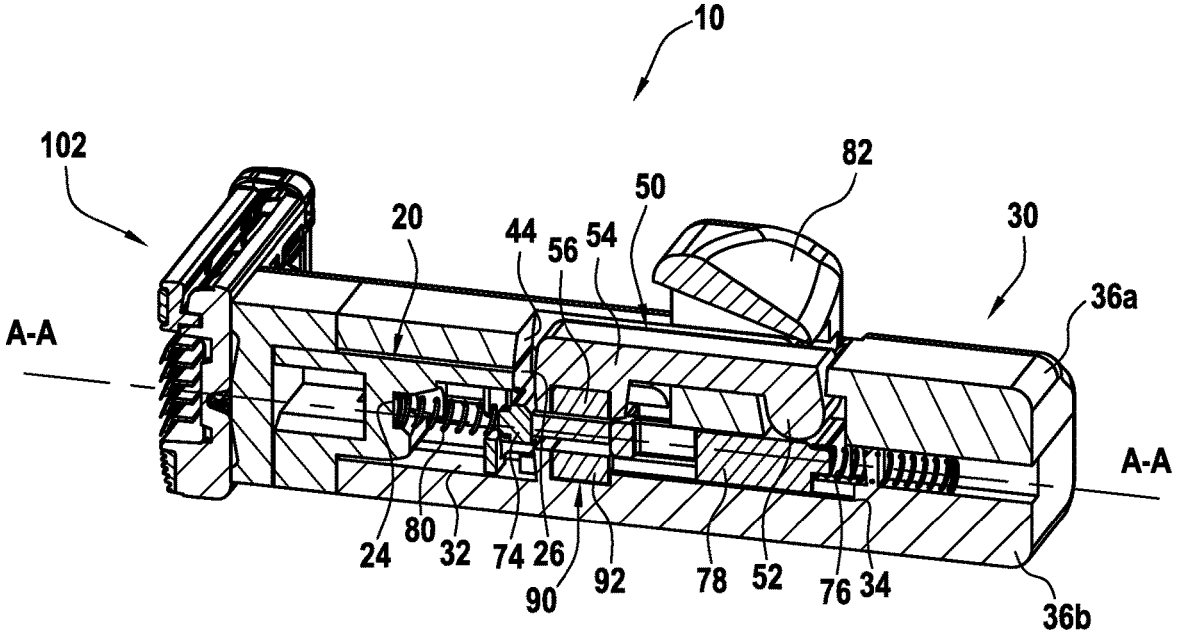
FIG. 7 is a side cross-sectional perspective view of the coupling mechanism of FIG. 1.
Figure 8:
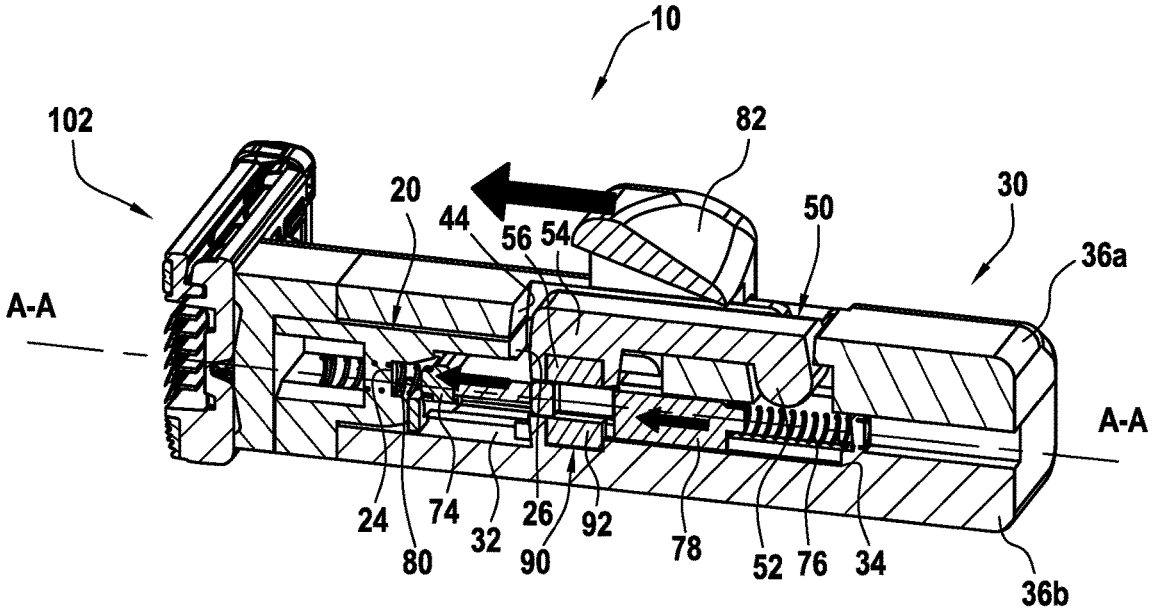
FIG. 8 is a side cross-sectional perspective view of the coupling mechanism of FIG. 1.
Figure 9:
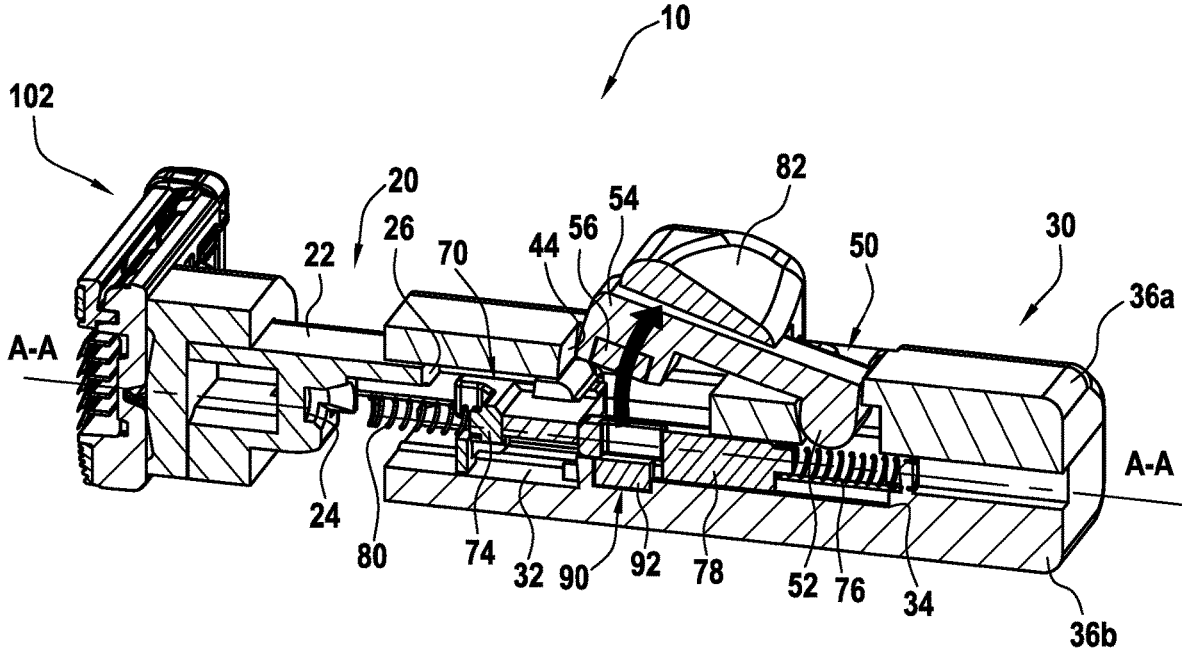
FIG. 9 is a side cross-sectional perspective view of the coupling mechanism of FIG. 1.

As illustrated by FIGS. 7-9, manipulation of the button 82 by a user may cause the button 80 to push the second coupling element 70 from the second coupling element second position toward the second coupling element first position. Pushing the second coupling element 70 toward the second coupling element first position may cause the metal plate 72 of the second coupling element 70 to no longer align with the magnet 56 of the first coupling element 50 and the magnet 92 of the third coupling element 90. Once the metal plate 72 of the second coupling element 70 is no longer aligned with the magnet 56 of the first coupling element 50 and the magnet 92 of the third coupling element 90, the magnet 56 of the first coupling element 50 and the magnet 92 of the third coupling element 90 may repel each other and force the locking member 54 out of engagement with the slot 26 of the first connector 20. Once the locking member 54 is forced out of engagement with the slot 26 of the first connector 20, the first bias member 76 and/or the second bias member 80 may expand, causing the first connector 20 to be ejected from the second connector 30. As such, the coupling mechanism 10 is configured to utilize magnetic components and metallic components for coupling and decoupling the shaving cartridge 102 to and from the handle, without the use of magnetic components or metallic components included by the shaving cartridge 102.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

Additionally, all of the disclosed features of an apparatus may be transposed, alone or in combination, to a method and vice versa.

The invention claimed is:

1. A coupling mechanism for a shaving device comprising:

a first connector;

a second connector defining a cavity being configured to receive the first connector;

a first coupling element included on the second connector, the first coupling element configured to move between a first coupling element first position and a first coupling element second position; and a second coupling element also included on the second connector and positioned within the cavity, the second coupling element configured to move between a second coupling element first position and a second coupling element second position;

wherein, movement of the second coupling element to the second coupling element second position causes the first coupling element to be maintained in the first coupling element second position to secure engagement of the first connector and the second connector, and wherein the first coupling element is configured to pivot about the second connector.

2. The coupling mechanism of claim 1, wherein a third coupling element is included within the second connector, and the third coupling element is configured to repel the first coupling element when the second coupling element is in the second coupling element first position.

3. The coupling mechanism of claim 2, wherein the third coupling element is configured to be attracted to the second coupling element.

4. The coupling mechanism of claim 1, wherein the first coupling element is configured to be attracted to the second coupling element.

5. The coupling mechanism of claim 2, wherein two of the first coupling element, the second coupling element, and the third coupling element include a magnet, and one of the first coupling element, the second coupling element, and the third coupling element includes a ferromagnetic material.

6. The coupling mechanism of claim 1, wherein the first coupling element is aligned with the second coupling element when the first coupling element is in the first coupling element second position and the second coupling element is in the second coupling element second position.

7. The coupling mechanism of claim 1, wherein the first coupling element is configured to pivot between the first coupling element first position and the first coupling element second position.

8. The coupling mechanism of claim 1, wherein the first connector defines a slot and the second connector defines an opening, and the slot is configured to align with the opening.

9. The coupling mechanism of claim 8, wherein the first coupling element is configured to extend through the opening and the slot when the first coupling element is in the first coupling element second position.

10. The coupling mechanism of claim 1, wherein the first connector includes an engagement surface configured to engage the second coupling element, and engagement of the second coupling element by the engagement surface moves the second coupling element toward the second coupling element second position when the first connector is inserted into the cavity.

11. The coupling mechanism of claim 10, wherein the second coupling element includes a bias member and the first connector compresses the bias member to move the second coupling element toward the second coupling element second position.

12. The coupling mechanism of claim 11, wherein the engagement surface of the first connector engages the bias member.

13. The coupling mechanism of claim 11, wherein the bias member is compressed against an inner wall of the second connector.

14. The coupling mechanism of claim 1, further comprising a button connected to the second coupling element, and the button is configured to move the second coupling element to the second coupling element first position.

15. A shaving device comprising:

a handle;

a shaving cartridge; and the coupling mechanism of claim 1, wherein, the shaving cartridge is coupled to the handle when the first connector and the second connector are securely engaged.

16. The coupling mechanism of claim 1, wherein the second connector comprises an opening configured to receive a locking member of the first coupling element due to pivoting of the first coupling element.

17. The coupling mechanism of claim 16, wherein the first connector comprises a slot configured to engage the locking member of the first coupling element that is received on the opening of the second connector due to pivoting of the first coupling element.

18. A coupling mechanism for a shaving device comprising:

a first connector;

a second connector defining a cavity being configured to receive the first connector;

a first coupling element included on the second connector, the first coupling element configured to move between a first coupling element first position and a first coupling element second position; and a second coupling element also included on the second connector and positioned within the cavity, the second coupling element configured to move between a second coupling element first position and a second coupling element second position;

wherein, movement of the second coupling element to the second coupling element second position causes the first coupling element to be maintained in the first coupling element second position to secure engagement of the first connector and the second connector, and wherein the first coupling element is configured to pivot between the first coupling element first position and the first coupling element second position.

19. A coupling mechanism for a shaving device comprising:

a first connector;

a second connector defining a cavity being configured to receive the first connector;

a first coupling element included on the second connector, the first coupling element configured to move between a first coupling element first position and a first coupling element second position;

a second coupling element also included on the second connector and positioned within the cavity, the second coupling element configured to move between a second coupling element first position and a second coupling element second position; and a third coupling element included within the second connector, wherein the third coupling element is configured to repel the first coupling element when the second coupling element is in the second coupling element first position.

20. The coupling mechanism of claim 19, wherein the third coupling element is configured to be attracted to the second coupling element.

* * * * *